United States Patent [19]

Morris

[11] 4,380,421

[45] Apr. 19, 1983

[54] DIE FOR COMPACTION OF POWDER

[75] Inventor: David G. Morris, Lausanne, Switzerland

[73] Assignee: Institut Cerac S.A., Ecublens, Switzerland

[21] Appl. No.: 317,599

[22] Filed: Nov. 3, 1981

[30] Foreign Application Priority Data

Nov. 10, 1980 [SE] Sweden ..... 8007874

[51] Int. Cl.[3] ..... B29C 1/00; B30B 11/02; B22F 3/00

[52] U.S. Cl. ..... 425/78; 425/352; 425/425; 249/134

[58] Field of Search ..... 249/134; 425/77, 78, 425/352, 421, 425, 431, 432

[56] References Cited

U.S. PATENT DOCUMENTS

| | | | |
|---|---|---|---|
| 3,005,491 | 10/1961 | Wells | 249/134 X |
| 3,461,506 | 8/1969 | Rice et al. | 425/78 |
| 3,461,507 | 8/1969 | Rice | 249/134 X |
| 3,632,242 | 1/1972 | Rasquin et al. | 425/77 |

*Primary Examiner*—J. Howard Flint, Jr.
*Attorney, Agent, or Firm*—Eric Y. Munson

[57] ABSTRACT

A die for compacting powder by dynamic compaction. The die is intended for compaction pressures substantially above 1 GPa. The die is made of a mixture of a plastic material and a metal powder. The die has the same density before compaction as the powder to be compacted. Furthermore, the die undergoes the same increase in density during compaction as the powder being compacted. The die is cheap relative to a steel die and can, thus, be made for single use. The range of geometries possible to compact is greatly extended.

3 Claims, 7 Drawing Figures

DIE FOR COMPACTION OF POWDER

The present invention relates to a die for compaction of powder by the impact of a punch.

In prior art dynamic compaction of powder solid steel dies have normally been used to support the powder. When a high velocity punch is impacted on the powder to create the compacting shock wave a number of problems arise depending on the very high pressure created and the different characteristics of powder and die. Firstly, when the shock front reaches the powder-die interface the high pressure behind the front is reflected so that wave interaction and cracking is normally caused within the compacted object; this occurs more often the higher the pressure is. Secondly, the extra high pressure may cause undesirable microstructural changes, such as those caused by overheating, within the object being compacted. Thirdly, the very high pressures generated in the die will very quickly lead to die deformation and breakage. In addition to being expensive to replace, the dies create problems of removal from the compaction chamber, which may itself have suffered deformation. Fourthly, the geometry of the compacted object is limited to forms having relatively gentle changes of section and large raddi of curvature. Otherwise, unacceptable pressure changes and wave speed changes would occur around the powder-die interface.

The object of the present invention is to propose a die having such characteristics that all of the above mentioned problems are avoided.

When a shock wave passes through a material there is an almost instantaneous change of pressure, density and particle velocity at the shock front. These changes are different for different materials and depending on the strength of the shock wave. The relationship between, for instance, pressure change and density change or pressure change and particle velocity change are normally called the Hugoniots of the material. It is sufficient to know one of these relationships because the other relationships can be calculated from the known one. The Hugoniot of a particular material may easily be obtained by performing a small number of tests where the material is impacted by a punch at different velocities and the change in pressure and particle velocity are measured.

The present invention, which is defined by the appended claims, is mainly characterized by the choice of material of the die. It has been found that all the above mentioned problems with solid steel dies are avoided if the die is matched to the powder in such a way that the density of the die is substantially equal to the density of the powder before compaction and the change of density created by the shock wave is substantially equal for die and powder. Substantially equal in this respect means that the difference is density is less than 15%. Preferably the difference should be less than 5%. The requirements of good matching become more exacting at higher shock pressures. If the die is, in this way, properly matched to the powder, the characteristics of the shock wave are unaffected by the powder-die interface. This means that all interactions are avoided by making shock pressure, particle velocity and shock speed the same in powder and die.

The invention is exemplified below with reference to the accompanying drawings in which FIG. 1 shows the Hugoniots of a tool steel powder and some die materials.

Figure 1:
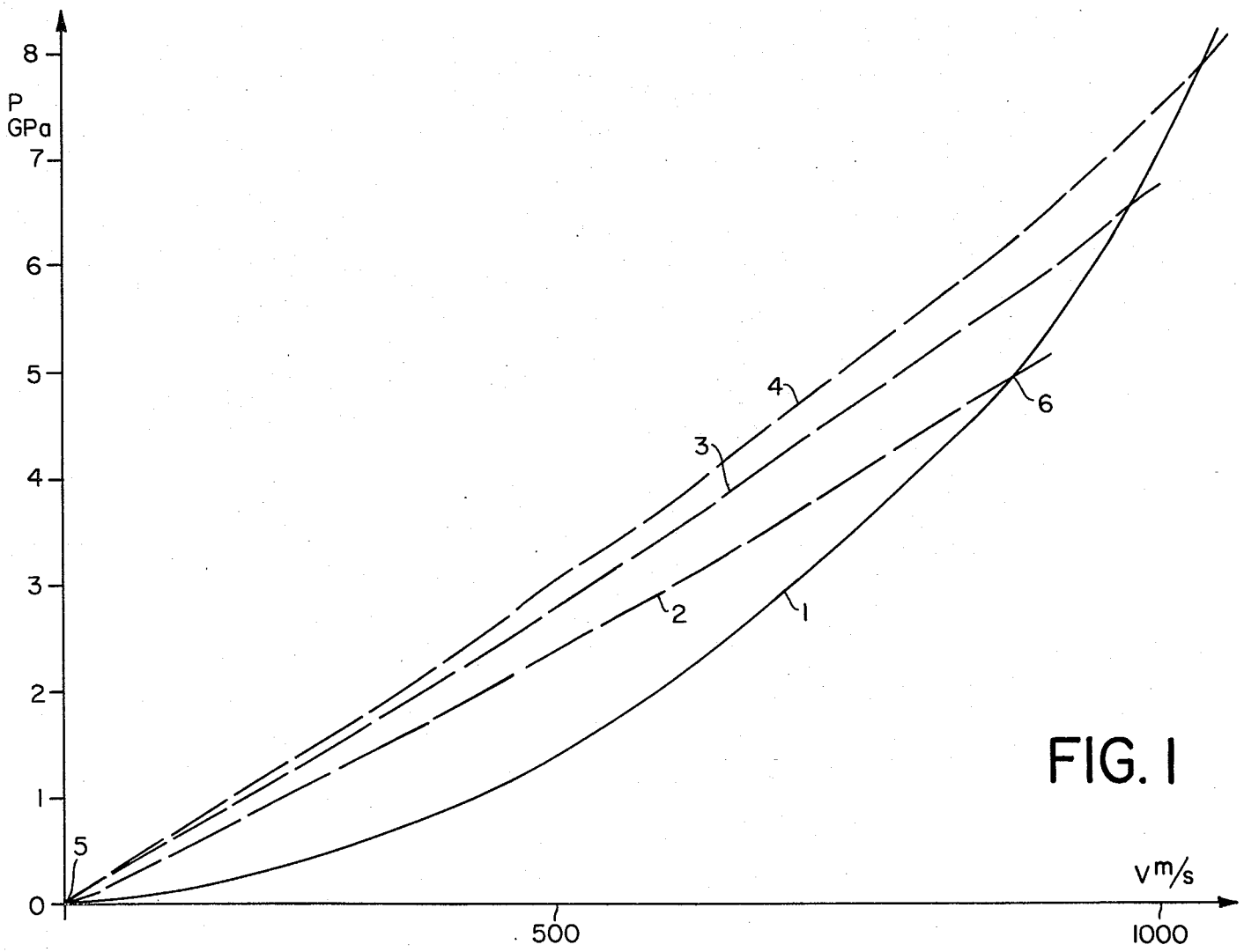

In FIG. 1 curve 1 represents the Hugoniot for a tool steel powder having an initial density of 3.5 g/cm$^3$. Curves 2, 3 and 4 represent the Hugoniots for mixtures of a commercial two component plastic, which is sold under the name Technovit 4071, and different metal powders, the mixtures having the same initial densities, 3.5 g/cm$^3$, as the tool steel powder. With tungsten powder added curve 2 is obtained. With lead powder added curve 3 is obtained. With nickel powder added curve 4 is obtained. Curves 1 to 4 show the compaction pressure p as a function of the particle velocity v.

Proper matching of die and powder requires the initial densities to be the same. This means, for a given powder to be compacted, that there is only one possible composition of a particular plastic material and a particular metal powder in the die. If, for instance, a punch is impacted on the powder with such a velocity that a compaction pressure of 5 GPa is created, point 6 in FIG. 1, the second requirement, that of equal increase of density for powder and die, requires that the Hugoniot of the die material passes through point 6. This is, in this example, achieved with the mixture containing tungsten powder, curve 2. Thus, the die is properly matched to this tool steel powder and a compaction pressure of 5 GPa if the Hugoniots of both the steel powder and the die material pass through points 5 and 6 in FIG. 1. As can be seen in FIG. 1 the plactic-lead die material matches at a compaction pressure of 6.5 GPa and the plastic-nickel die material at 8 GPa.

In order to obtain a good die it is necessary to use either a fairly fast setting and viscous plastic or heat-setting plastic so that gravitational settling of the metallic powder is avoided during the hardening process. Since there is only one possible mixture of a given plastic material and a given filler material which gives the same initial density as that of the powder to be compacted, proper matching for a selected compaction pressure must be found through variation of either or both of the components of the material. The material may, of course, contain more than two components. The above mentioned examples contain a mixture of a plastic material and a metal powder. It may, of course, be possible to find other material combinations which fulfil the requirements of proper matching to the powder to be compacted. In particular the die material may also contain porosity which can be a useful parameter for controlling the shock behaviour.

Figure 2:
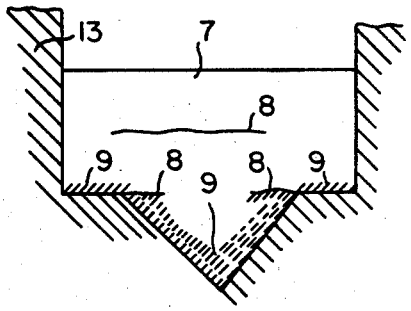
FIGS. 2 and 3 show what may become the result if the die is not matched to the powder.
Figure 3:
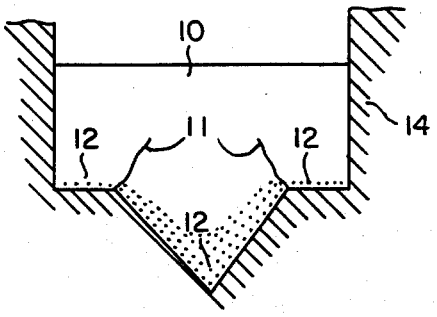
Figure 4:
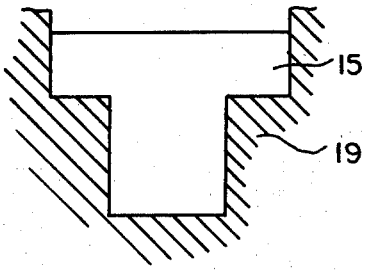
FIGS. 4 to 7 show some examples of specimens which have been successfully compacted in dies according to the present invention.

FIGS. 2 and 3 show what frequently happens at a compaction pressure of 5 GPa if the die is not matched to the powder. FIG. 2 shows a piece of tool steel 7 compacted in a die 13 of plastic without filler. The piece contains cracks 8 and poorly compacted regions 9. FIG. 3 shows a piece of tool steel 10 compacted in a die 14 of steel. The piece contains cracks 11 and overcompacted, overheated, regions 12.

Figure 5:
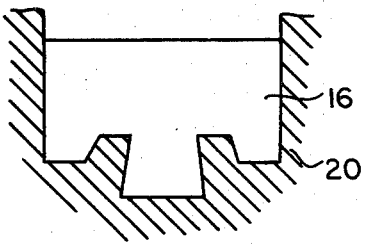
Figure 6:
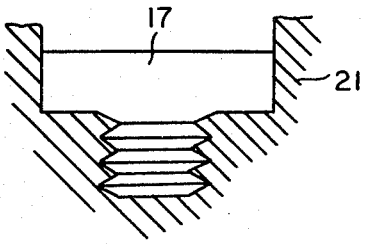
Figure 7:
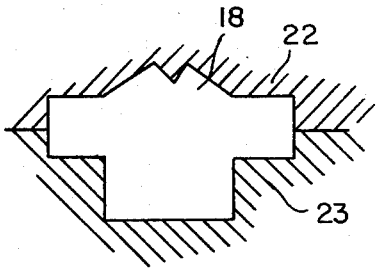

FIGS. 4 to 7 show some examples of specimens 15, 16, 17 and 18, which have been successfully compacted in dies 19, 20, 21 and 22, 23 according to the present invention. The cross-sectional areas of these specimens were approximately circular, but this is not necessary. Since dies according to the present invention are cheap compared to steel dies they can be made for single use. Furthermore, the matching of shock compression behaviour considerably extends the range of geometries that can be compacted. For instance, specimens having reentrant geometries, as shown in FIG. 5, specimens having thread-like parts as shown in FIG. 6 or specimens completely enclosed in the die, or die parts, as shown in FIG. 7.

Below three examples of successful compactions according to the invention are given.

1. A tool steel powder of initial density 3.5 g/cm$^3$ was impacted by a plastic punch at a velocity of 2000 m/s, thereby creating a compaction pressure of 5 GPa. The powder was supported by a die composed of a mixture of Technovit 4071 plastic and tungsten powder. The die had an initial density of 3.5 g/cm$^3$. The compacted piece had the form shown in FIG. 6. The threaded portion had a dimater of 14 mm and a length of 15 mm, while the head had a diameter of 25 mm and a length of 10 mm. The compacted piece showed no signs of cracking or of over- or under-compaction.

2. A tool steel powder of initial density 3.5 g/cm$^3$ was impacted by a plastic punch at a velocity of 1300 m/s, thereby creating a compaction pressure of 2.5 GPa. The powder was supported by a die composed of a mixture of a commercial PVC glue and iron powder. The die had an initial density of 3.5 g/cm$^3$. The compacted piece had the form shown in FIG. 4. The larger diameter was 50 mm, the smaller diameter 30 mm and the length of each portion 10 mm. The compacted piece was free of defects.

3. An aluminium powder of initial density 1.4 g/cm$^3$ was impacted by a plastic punch at a velocity of 1500 m/s, thereby generating a compaction pressure of 1.5 GPa. The powder was supported by a die composed of a mixture of Technovit 4071 plastic and iron powder with considerable fine scale porosity. The die had an initial density of 1.4 g/cm$^3$. The die geometry was that of FIG. 2. The compacted piece had a cylinder diameter of 50 mm. The cone angle was 90° and the cone depth 10 mm. No defects were found in the compacted object.

I claim:

1. A die for compaction of powder by passing a shock wave, created by the impact of a punch, through the powder, characterized thereby that the density of the die before compaction of the powder is substantially equal to the density of the powder to be compacted and that the increase in the density caused by the passing shock wave in the powder and in the die are substantial equal.

2. A die according to claim 1, characterized thereby that the die comprises a mixture of a plastic material and a metal powder.

3. A die according to claim 2, characterized thereby that the metal powder is porous.

* * * * *